US006781026B2

(12) United States Patent
Lee

(10) Patent No.: US 6,781,026 B2
(45) Date of Patent: Aug. 24, 2004

(54) AROMATICS PURIFICATION FROM PETROLEUM STREAMS

(75) Inventor: Fu-Ming Lee, Katy, TX (US)

(73) Assignee: GTC Technology Inc., Houston, TX (US)

( * ) Notice: Subject to any disclaimer, the term of this patent is extended or adjusted under 35 U.S.C. 154(b) by 0 days.

(21) Appl. No.: 10/274,155

(22) Filed: Oct. 21, 2002

(65) Prior Publication Data

US 2003/0042125 A1 Mar. 6, 2003

Related U.S. Application Data

(63) Continuation of application No. 09/842,125, filed on Apr. 26, 2001, now abandoned.
(60) Provisional application No. 60/200,565, filed on Apr. 28, 2000.

(51) Int. Cl.[7] ..... C07C 7/00; C07C 7/17
(52) U.S. Cl. ..... 585/864; 585/857; 585/862; 585/866
(58) Field of Search ..... 585/864, 857, 585/862, 866

(56) References Cited

U.S. PATENT DOCUMENTS

| | | | |
|---|---|---|---|
| 2,455,803 | A | 12/1948 | Pierotti |
| 3,114,783 | A | 12/1963 | Butler et al. |
| 3,591,490 | A | 7/1971 | Müller et al. |
| 3,723,526 | A | 3/1973 | Edgerton |
| 3,816,302 | A | 6/1974 | Paret |
| 4,053,369 | A | 10/1977 | Cines |
| 4,278,505 | A | 7/1981 | Danulat et al. |
| 4,488,937 | A | 12/1984 | Berg et al. |
| 5,032,232 | A | 7/1991 | Lee et al. |
| 5,849,982 | A | 12/1998 | Lee et al. |

FOREIGN PATENT DOCUMENTS

| | | |
|---|---|---|
| EP | 0 679 708 A | 11/1995 |
| FR | 2120863 | 8/1972 |
| WO | WO 99/11740 | 3/1999 |

OTHER PUBLICATIONS

Atkins & Boyer, "Application of McCabe–Thiele Method to Extractive Distillation Calculations", *Chemical Engineering Progress*, 1949, pp. 55–562, vol. 45, No. 9.

Chambers, "Extractive Distillation, Design and Application", *Chemical Engineering Progress*, 1951, pp. 555–565, vol. 47, No. 11.

Hachmuth, "Industrial Viewpoints on Separation Processes", *Chemical Engineering Progress*, 1952, pp. 617–626, vol. 48, No. 12.

Mcgraw–Hill Companies, Inc., *Perry's Chemical Engineers' Handbook*; 1999, pp. 13–75–13–81.

Lee, Extractive Distillation: Separating Close–Boiling Point Components, *Chemical Engineering*, 1998.

European Patent Office, PCT Written Opinion, Apr. 10, 2002 In counterpart PCT application (i.e., PCT/US01/13411).

Dimitrios P. Tassios, "Extractive and Azeotropic Distillation: Rapid screening of Extractive Distillation Solvents", *Advances in Chemistry, American Chemical Society*, 1972, pp. 46–63, Series #115.

*Primary Examiner*—Walter D. Griffin
*Assistant Examiner*—Tam M. Nguyen
(74) *Attorney, Agent, or Firm*—Jenkens & Gilchrist a Professional Corporation

(57) ABSTRACT

A process for separating a feed mixture comprising at least one aromatic hydrocarbon and at least one non-aromatic hydrocarbon by extractive distillation (ED) utilizing a solvent mixture comprising sulfolane and at least one co-solvent. The co-solvent is an alkyl sulfolane having from 4 to 8 carbon atoms per molecule. The solvent mixture is added to the top of the ED column, and the feed mixture is added at a point on the ED column that is lower than the point where the solvent mixture is added. Extractive distillation is performed, and the aromatic and non-aromatic hydrocarbons are separated.

12 Claims, 1 Drawing Sheet

AROMATICS PURIFICATION FROM PETROLEUM STREAMS

This is a continuation of application Ser. No. 09/842,125 filed Apr. 26, 2001, now abandoned.

This application claims the benefit of U.S. Provisional Application No. 60/200,565, filed Apr. 28, 2000.

BACKGROUND OF THE INVENTION

Separation of very close boiling components, such as aromatic and non-aromatic hydrocarbons, is both impractical and uneconomical by conventional distillation. One alternative method of separating close boiling components is extractive distillation (ED). In an ED column, a polar, nonvolatile solvent is introduced into the column near the top to preferentially associate with the more polar components in the feed mixture, so that the relative volatility between the close boiling components can be significantly increased, making the separation possible. A cosolvent may be added to improve solvency or solubility, and to improve overall efficiency of the primary solvent. The relative volatility ($\alpha$) is a way of expressing the solvent selectivity, and is related to the number of theoretical stages required for the separation. As $\alpha$ increases, the number of theoretical stages or trays needed to achieve separation decreases. This results in a more commercially viable separation and reduces energy consumption. However, choosing solvent/cosolvent pairs is difficult, and requires actual testing.

The basic principles, design, and operation of ED processes have been thoroughly discussed in the literature, including: Atkins, G. T. et al., "Application of McCabe-Thiele Method to Extractive Distillation Calculations," Chem. Eng. Prog., 45(9), 553–562 (1949); Chambers, J. M., "Extractive Distillation Design and Application," Chem. Eng. Prog., 47(11), 555–565 (1951); Hackmuth, K. H., "Industrial Viewpoints on Separation Processes," Chem. Eng. Prog., 48(12), 617–626 (1952); Butler, et al., U.S. Pat. No. 3,114,783; and Perry's Chemical Engineers' Handbook, 6th Edition, Mcgraw-Hill Book Company, 1984, pp.13–53 to 13–57. These disclosures are incorporated herein by reference.

Use of extractive distillation to separate aromatics is known, in particular for separating benzene, toluene, and xylene from non-aromatics, where the aromatic and non-aromatic compounds have close boiling points. For example, U.S. Pat. No. 3,591,490 shows a process for separating aromatic hydrocarbons from hydrocarbon mixtures using N-methyl-pyrrolidone or dimethylformamide as a solvent. U.S. Pat. No. 3,723,526 shows a method of recovering aromatic hydrocarbons from a mixture of aromatic and non-aromatic hydrocarbons by a combination of preliminary fractionation, extractive distillation of the fractionation overhead, and solvent extraction of the fractionation bottoms, using sulfolane or other related solvents. U.S. Pat. No. 4,053,369 shows an extractive distillation process that operates with two liquid phases, at an optimized reflux ratio, allowing decreased amounts of solvent to be used. The solvent is chosen to be highly selective, and is preferably a sulfolane-type solvent. Finally, U.S. Pat. No. 4,278,505 shows a process of recovering n-hexane free from aromatic compounds by extractive distillation with a selective solvent such as N-methyl pyrrolidone.

Fu-Ming Lee, "Extractive Distillation: Close-Boiling-Point" Chemical Engineering, 112–120 (1998), describes the use of cosolvents to make difficult separations more economically feasible. This article provides data for the selectivity and solvency of various solvents, as well as their polarity. Solvent/cosolvent pairs tested in the article include cyclohexanol and ethylene glycol, cyclohexanol and tetra ethylene glycol, N-methyl pyrrolidone and ethylene glycol, tetra ethylene glycol and N-methyl pyrrolidone, 3-methyl sulfolane and water, di-n-propyl sulfone and water, and 3-methyl sulfolane and dimethyl sulfone. The article indicates that choosing solvent/cosolvent pairs is difficult due to current limitations on the understanding of the behavior of polar components in solution, so experimentation is necessary to screen cosolvents.

However, none of the above documents teaches the novel solvent and cosolvent combinations that are the subject of the present invention. Accordingly, there is a need to develop more suitable solvents and solvent mixtures than those presently known for use in the ED of mixtures of aromatic and non-aromatic hydrocarbons.

SUMMARY OF THE INVENTION

The present invention provides an effective process for separating mixtures of close-boiling aromatics and non-aromatics by extractive distillation using a polar organic solvent or a mixture of polar organic solvents. High purity aromatics may thus be produced from a mixture comprising aromatics and non-aromatics by extractive distillation employing a novel polar organic solvent or a novel mixture of polar organic solvents. Other objects and advantages will be apparent from the detailed description of the invention and the appended claims.

According to one embodiment of the present invention, a process for separating one or more aromatic hydrocarbons from one or more non-aromatic hydrocarbons, in which a feed mixture thereof is subjected to extractive distillation in an extractive distillation column, using sulfolane as extraction solvent, includes the improvement wherein the extraction solvent also includes at least one cosolvent selected from the group consisting of 3-methyl sulfolane, N-methyl-2-pyrrolidone, acetophenone, isophorone, and morpholine.

DETAILED DESCRIPTION OF THE PREFERRED EMBODIMENTS

Figure 1:
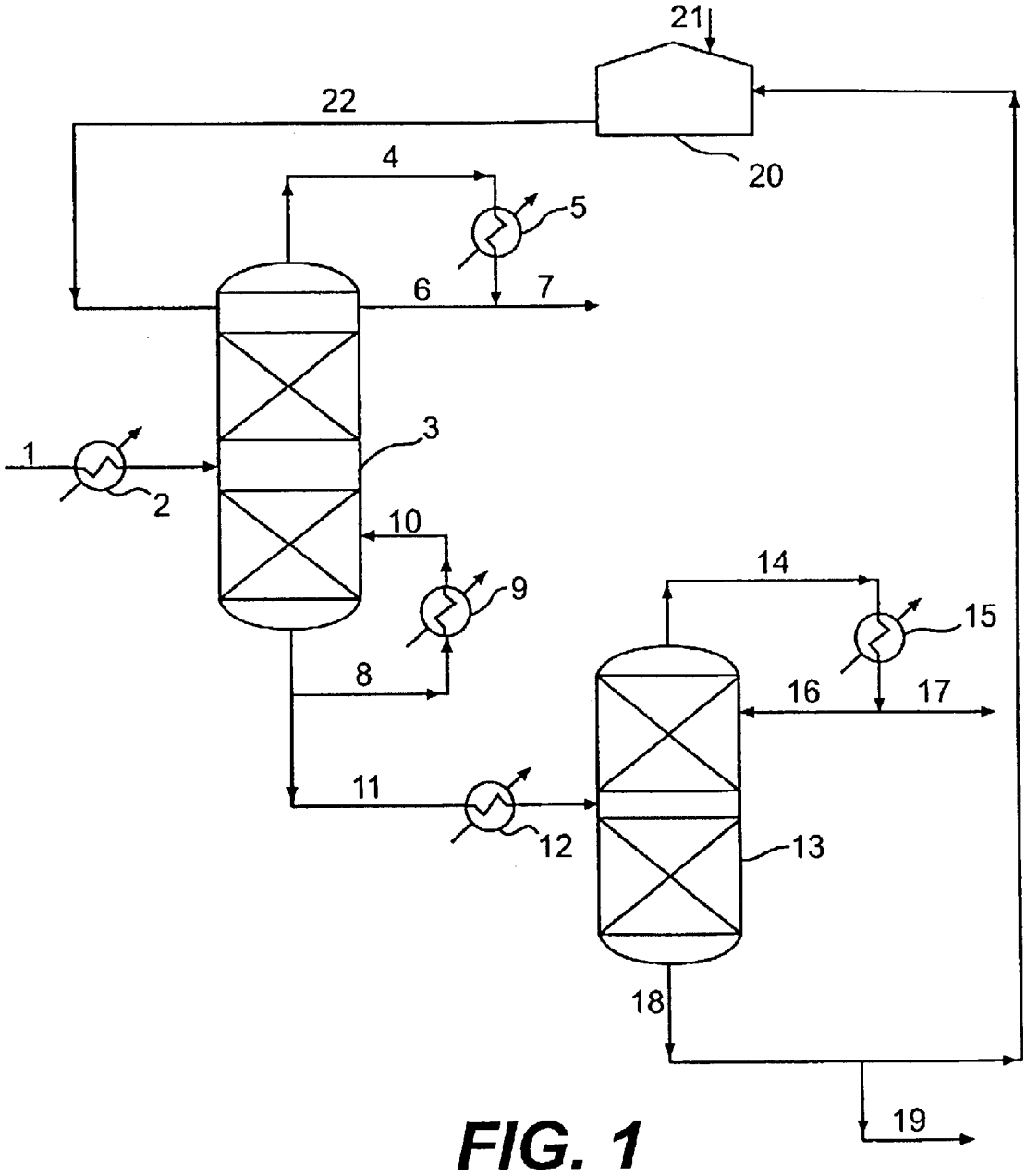
FIG. 1 graphically illustrates a preferred embodiment of the extractive distillation process according to the present invention.

FIG. 1 illustrates a preferred process and apparatus according to the present invention. The feed mixture comprising aromatic hydrocarbon(s) and non-aromatic hydrocarbon(s) is introduced through conduit 1 to the middle portion of a multi-stage ED column 3. The temperature of the feed mixture flowing through conduit 1 can be adjusted by controlling heat exchanger 2 so as to add heat to or remove heat from the feed mixture. Solvent from solvent storage unit 20 is introduced to ED column 3 through conduit 22, and an overhead stream enriched in non-aromatic hydrocarbon(s) is withdrawn from the upper portion of ED column 3 through conduit 4. This overhead stream can be completely passed to storage or to other processing units or, as is often the case, the overhead stream can be partially or total condensed, with a portion thereof being returned to ED column 3 as reflux. The overhead stream passing through conduit 4 is condensed in condenser 5 to yield a condensed overhead stream. A portion of the condensed overhead stream can be returned to ED column 3 as reflux through conduit 6, while the remainder of the condensed overhead stream yields product, or is passed to other processing units through conduit 7.

A bottoms stream is withdrawn from a lower portion of ED column 3 through conduit 11. A portion of the stream withdrawn from the bottom of ED column 3 may be heated and returned to ED column 3. For example, according to a preferred embodiment, a portion of the bottoms product stream can be withdrawn through conduit 8, heated in reboiler 9 and then passed back to the lower portion of ED column 3 through conduit 10.

Operating conditions in heat exchanger 2, condenser 5 and reboiler 9 can be controlled and interfaced with solvent flow through conduit 22, feed mixture flow through conduit 1, reflux flow through conduit 6 and bottoms stream flow through conduit 11 such that the feed mixture introduced into ED column 3 will be fractionated to yield an overhead stream which is enriched in non-aromatic hydrocarbon(s) and a bottoms stream predominantly comprising aromatic hydrocarbon(s) and the solvent.

The bottoms stream passing through conduit 11 can be transferred to storage, used in other processes or, preferably, passed to another distillation column 13 (usually referred as solvent stripper). Any adjustments to the temperature of the bottoms stream passing through conduit 11 necessary for efficient fractionation (stripping) in column 13 can be made by appropriately adjusting heat exchanger 12. An overhead stream predominantly comprising aromatic hydrocarbon(s) is withdrawn from the upper portion of column 13 through conduit 14. This overhead stream can be at least partially condensed in condenser 15. A portion of the overhead stream withdrawn from condenser 15 can be returned through conduit 16 as reflux for column 13, with the remainder of the overhead stream being withdrawn as product, i.e., aromatic hydrocarbon(s) of high purity, through conduit 17.

A bottoms stream predominantly comprising the solvent (usually referred to as lean solvent) is withdrawn from the lower portion of column (stripper) 13 through conduit 18. A portion of this bottoms stream is preferably routed back to solvent storage unit 20 and then recycled to ED column 3, while another portion of the bottoms stream is heated in a reboiler (not shown) and returned to the lower portion of column 13. From time to time impurities that may build up in the solvent can be removed from the system by removing a small purge stream through conduit 19. Solvent lost through the purge stream or through other processing losses may be made up by a makeup stream passing through conduit 21 and into solvent storage unit 20.

In an extractive distillation (ED) process, the extractive agent (or solvent) is added to a feed mixture of components to be separated so that the volatility difference between the components of the mixture is enhanced and an effective separation by distillation becomes possible. The extractive agent and less volatile components flow to the bottoms of the distillation column, where the extracted component is recovered by a second subsequent distillation.

The extractive agent is usually chosen based on its selectivity for enhancing the relative volatility of the components to be separated and its solvency (solubility) for the feed mixture. Selectivity is a term related to the change in relative volatility of the feed components to be separated. The relative volatility ($\alpha$) is defined as $$\alpha=(Y_1/X_1)/(Y_2/X_2) \quad (1)$$

where $X_1$ and $X_2$ are the mole fractions of components 1 and 2, respectively, in the liquid phase, and $Y_1$ and $Y_2$ are the mole fractions of components 1 and 2, respectively, in the vapor phase. All components are measured in the absence of solvent. The larger the difference in $\alpha$ of the feed components to be separated, the easier the separation of the components by fractional distillation becomes. Therefore, a solvent with high selectivity is a solvent that causes great differences in a among the components to be separated, and thereby allows for the separation of components in a feed mixture with fewer distillation stages, a lower amount of reflux, and a higher product purity.

According to a preferred embodiment, any hydrocarbon feed which contains at least one aromatic hydrocarbon containing 6–10 carbon atoms per molecule and at least one close-boiling nonaromatic hydrocarbon (preferably containing 5–10 carbon atoms per molecule) can be used in the extractive distillation process. Preferably, the boiling points (at atmospheric pressure conditions, i.e., at about 1 atm.) of the aromatic hydrocarbon(s) and of the non-aromatic hydrocarbon(s) to be separated by extractive distillation process of this invention, are in the range of from about 25 to about 175° C., more preferably about 40 to about 150° C. Generally, the boiling points of the aromatic hydrocarbon(s) and of the nonaromatic hydrocarbon(s) are close, and differ by about 0.1–5° C. (preferably 0.3–3° C.) at about 1 atm.

Preferably, the aromatics content in the feed is about 10–95 weight % (more preferably about 20–80 weight %), and the non-aromatics content is about 5–90 weight % (more preferably about 20–80 weight %).

Non-limiting examples of preferred feed non-aromatic hydrocarbons are n-pentane, n-hexane, 2-methylpentane, 3-methylpentane, n-heptane, 2,2-dimethylpentane, 2,4-dimethylpentane, 3,3-dimethylpentane, 2,3-dimethylpentane, 2-methylhexane, 3-methylhexane, 2,2,3-trimethylbutane, n-octane, 2-methyloctane, n-nonane, and the like, and mixtures thereof, in particular mixtures containing n-heptane.

Non-limiting examples of preferred feed aromatic hydrocarbons are benzene, toluene, meta-, ortho-, and para-xylenes, ethylbenzene, trimethylbenzene, methylethylbenzene, and the like, and mixtures of the above. Particularly preferred aromatic hydrocarbons are benzene, toluene, and xylene.

Preferably, the co-solvent used contains 4–8 carbon atoms per molecule. Nonlimiting examples of the co-solvent for this invention are 3-methyl sulfolane, N-methyl-2-pyrrolidone, acetophenone, isophorone, morpholine, and mixtures thereof. The presently preferred co-solvents are 3-methylsulfolane and N-methyl-2-pyrrolidone.

According to a preferred embodiment, any suitable weight ratio of component (b) (the co-solvent) to component (a) (sulfolane) in the solvent, that shows a synergistic effect in performance, can be employed in the extractive distillation process. Preferably, the weight ratio of component (a) to component (b) is in the range of from about 0.1:1 to about 20:1, more preferably from about 0.1:1 to about 10:1.

Any suitable weight ratio of the solvent to any of the above-described hydrocarbon-containing feed mixtures can be employed. Preferably, the solvent to feed weight ratio is in the range of from about 0.5:1 to about 40:1, and is more preferably in the range of from about 0.5:1 to about 20:1.

Any suitable feed entry location can be selected. In general, the feed entry location is in the range of from about 2 to about 70 percent of the total height of the packed or trayed column, measured upward from the bottom of the column, preferably in the range of from about 5 to about 60 percent, and more preferably in the range of from about 7 to about 50 percent.

Any suitable solvent entry location can be selected. Generally, the solvent entry location is in the range of from about 50 to about 99 percent of the total height of the packed or trayed column, preferably in the range of from about 70 to about 99 percent, and more preferably in the range of from about 80 to about 99 percent.

Any suitable reflux ratio (i.e., the weight ratio of the portion of condensed vapor that is returned to the distillation column to the portion of condensed vapor that is withdrawn as distillate) can be employed. In general, the reflux ratio is in the range of from about 0:1 to about 100:1, preferably in the range of from about 0.1:1 to about 50:1, more preferably in the range of from about 0.1:1 to about 5:1.

Any suitable temperature in the distillation kettle (reboiler) can be employed. The temperature is generally in the range of from about 40° to about 210° C., preferably in the range of from about 65° to about 160° C. The ED column is generally heated more near the bottom, and less near the top. In general, the temperature at the top of the column where the vapor exits into the condenser is in the range of from about 40° to about 150° C., preferably in the range of from about 65° to about 120° C. Solvent and feed are usually preheated (generally to a temperature close to the column temperature of the corresponding entry point) before they are introduced into the packed or trayed column.

Any suitable pressure can be employed during the extractive distillation. The pressure can be from about 5 to about 100 psig, preferably from about 8 to about 20 psig.

The overhead product (withdrawn from the top of the column) contains a smaller volume percentage of aromatic hydrocarbon(s) than the feed, and a larger volume percentage of non-aromatic hydrocarbon(s) than the feed. Generally, the bottoms product (withdrawn from the bottom of the column) contains more aromatic hydrocarbon(s) than the feed, and less non-aromatic hydrocarbon(s) than the feed. Also, the bottoms product contains substantially all of the added solvent, which can be separated from the other bottoms components by simple distillation, since generally the solvent has much higher boiling point than the other bottoms components. The recovered lean solvent is preferably recycled to the ED column.

Any suitable packed length or number of trays in an ED column having suitable column diameter can be employed in the process of this invention. The exact column dimensions and design depend on the scale of the operation, the feed composition, the solvent composition, the desired recovery, and degree of purity of the various hydrocarbon products, and the like, and can be readily determined by one of ordinary skill in the art.

The following examples are presented to further illustrate the preferred embodiments of the present invention, and are not intended to limit the scope of the invention.

EXAMPLE 1

This example demonstrates the synergistic effect of mixing sulfolane (SULF) and 3-methyl sulfolane (3MSULF) versus each component alone in the extractive distillation of an aromatic/non-aromatic feed mixture.

A hydrocarbon mixture of approximately 50 weight % benzene and 50 weight % n-heptane was added to an ED solvent (either SULF or 3MSULF or a mixture of SULF and 3MSULF at various proportions) at a solvent-to-feed weight ratio of 3.0. The total mixture was heated to its boiling point under total reflux conditions for about 20 to 30 minutes in an equilibrium cell equipped with a reflux condenser. Then a small sample was withdrawn by means of a septum from the cell containing the liquid phase of the equilibrium system, and a sample of the condensed vapor was also withdrawn by means of a septum located just below the reflux condenser. Both samples were analyzed, and the weight fractions of n-heptane and benzene in the liquid phase and in the condensed vapor phase were determined by a gas chromatographic method. The relative volatility ($\alpha$) was calculated by Equation (1), where n-heptane is component 1 and benzene is component 2. The results are summarized in Table I.

TABLE I

| Added Solvent | S/F | Relative Volatility ($\alpha$) |
|---|---|---|
| No Solvent Added | 0.0 | 0.57 |
| SULF | 3.0 | 1.97 |
| 10% SULF/90% 3MSULF | 3.0 | 2.48 |
| 25% SULF/75% 3MSULF | 3.0 | 2.44 |
| 3MSULF | 3.0 | 2.34 |

The data in Table I show that, without adding solvent, the relative volatility ($\alpha$) of n-heptane over benzene is 0.57 (less than one) since the boiling point of n-heptane (98.4° C.) is much higher than that of benzene (80.1° C.). At an S/F ratio of 3.0, SULF and 3MSULF can, respectively, increase $\alpha$ from 0.57 to about 1.97 and 2.34, making the separation in the ED process possible. In an ED process, the less polar n-heptane will be removed as the overhead product and the more polar benzene will be removed as the bottoms product with the solvent, so $\alpha$ has to increase to a value larger than 1.0 under solvent. Larger $\alpha$ values indicate easier separation. Table I also shows the synergistic effect of mixing SULF and 3MSULF, showing that the mixtures give better a than either solvent alone, for separating n-heptane and benzene. It would be unexpected to one skilled in the art that the solvent/co-solvent combination of SULF and 3MSULF would produce this synergistic effect.

EXAMPLE 2

This example demonstrates the synergistic effect of mixing sulfolane (SULF) and N-methyl-2-pyrrolidone (NMP) versus each component alone in the extractive distillation of an aromatic/non-aromatic feed mixture.

Again, a hydrocarbon mixture of 50 weight % benzene and 50 weight % n-heptane was added to an ED solvent (either SULF or NMP or a mixture of SULF and NMP at various portions) at a solvent-to-feed weight ratio of 3.0. The experimental procedure in an equilibrium cell was repeated as in Example 1. The relative volatility ($\alpha$) was calculated by Equation (1), where n-heptane is component 1 and benzene is component 2. The results are summarized in Table II.

TABLE II

| Added Solvent | S/F | Relative Volatility ($\alpha$) |
|---|---|---|
| No solvent added | 0.0 | 0.57 |
| SULF | 3.0 | 1.97 |
| 75% SULF/25% NMP | 3.0 | 2.48 |
| 50% SULF/50% NMP | 3.0 | 2.67 |
| 25% SULF/75% NMP | 3.0 | 2.34 |
| NMP | 3.0 | 2.01 |

The data in Table II show that, at an S/F of 3.0, both SULF and NMP can individually increase $\alpha$ from 0.57 to about 2.00, making the separation in the ED process possible. However, the synergistic effect of mixing SULF and NMP shows that the mixtures give significantly better results than either solvent alone. In fact, solvent mixtures show a maximum performance at 50% SULF and 50% NMP in the ED process for separating n-heptane and benzene. It would be unexpected to one skilled in the art that the solvent/cosolvent combination of SULF and NMP would produce this synergistic effect.

EXAMPLE 3

This example illustrates the effectiveness of SULF and acetophenone (ACTN) in separating aromatic and non-aromatic compounds by extractive distillation. The apparatus and feed described in Example 1 were used for the test series of this example, which was carried out at an S/F of 3.0. Test results are summarized in Table III.

TABLE III

| Added Solvent | S/F | Relative Volatility (α) |
|---|---|---|
| No solvent added | 0.0 | 0.57 |
| SULF | 3.0 | 1.97 |
| 75% SULF/25% ACTN | 3.0 | 2.26 |
| 50% SULF/50% ACTN | 3.0 | 2.01 |
| 25% SULF/75% ACTN | 3.0 | 1.66 |
| ACTN | 3.0 | 1.27 |

Based on the test results in Table III, it is concluded that the SULF and ACTN mixtures containing lower percents of ACTN, such as approximately 25%, can be more effective than either SULF or ACTN alone. It would be unexpected to one skilled in the art that the solvent/co-solvent combination of SULF and ACTN would produce this synergistic effect.

EXAMPLE 4

This example illustrates the effectiveness of mixing still another co-solvent, isophorone (ISOP) with SULF in separating aromatic and non-aromatic compounds by extractive distillation. The apparatus and feed described in Example 1 were again used for the test series of this example, which was carried out at an S/F of 3.0. Test results are-summarized in Table IV.

TABLE IV

| Added Solvent | S/F | Relative Volatility (α) |
|---|---|---|
| No solvent added | 0.0 | 0.57 |
| SULF | 3.0 | 2.04 |
| 75% SULF/25% ISOP | 3.0 | 2.28 |
| ISOP | 3.0 | 1.16 |

Table IV shows that the mixture of 75% SULF and 25% ISOP is more effective in separating benzene and n-heptane than either SULF or ISOP alone. It would be unexpected to one skilled in the art that the solvent/co-solvent combination of SULF and ISOP would produce this synergistic effect.

EXAMPLE 5

This example illustrates the effectiveness of SULF and morpholine (MORP) in separating aromatic and non-aromatic compounds by extractive distillation. The apparatus and feed described in Example 1 were used for the test series of this example, which was carried out at an S/F of 3.0. Test results are summarized in Table V.

TABLE V

| Added Solvent | S/F | Relative Volatility (α) |
|---|---|---|
| No solvent added | 0.0 | 0.57 |
| SULF | 3.0 | 2.04 |

TABLE V-continued

| Added Solvent | S/F | Relative Volatility (α) |
|---|---|---|
| 75% SULF/25% MORP | 3.0 | 2.27 |
| 50% SULF/50% MORP | 3.0 | 2.13 |
| 25% SULF/75% MORP | 3.0 | 1.73 |
| MORP | 3.0 | 1.44 |

Based on the test results in Table V, it is concluded again that the SULF and MORP mixtures containing lower percents of MORP, such as 25 to 50%, can indeed be more effective than either SULF or MORP alone. It would be unexpected to one skilled in the art that the solvent/co-solvent combination of SULF and MORP would produce this synergistic effect.

While the present invention has been described for what are at present considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

I claim:

1. A process for separating at least one aromatic hydrocarbon having 6–12 carbon atoms per molecule from at least one close-boiling non-aromatic hydrocarbon comprising extractively distilling a feed mixture comprising at least one aromatic hydrocarbon and at least one non-aromatic hydrocarbon in the presence of a solvent mixture, wherein the extractive distillation process takes place in an extractive distillation column and the solvent mixture is introduced into the extractive distillation column in a weight ratio of about 3 parts solvent mixture per part of feed mixture, said feed mixture comprising n-heptane and benzene, wherein the solvent mixture comprises between about 10–25% sulfolane by weight with the remainder being 3-methyl sulfolane.

2. The process of claim 1, wherein about 20–80 weight % of said feed mixture is aromatic hydrocarbon and about 20–80 weight % of said feed mixture is non-aromatic hydrocarbon.

3. The process of claim 1, wherein said feed mixture contains at least one aromatic hydrocarbon containing 6 to 10 carbon atoms per molecule.

4. The process of claim 1, wherein said feed mixture contains at least one non-aromatic hydrocarbon containing 5 to 10 carbon atoms per molecule.

5. The process of claim 1, wherein said solvent mixture and said feed mixture are introduced to the distillation column in a weight ratio of about 0.5 to 20 parts of solvent mixture per part of feed mixture.

6. The process of claim 1, wherein the extractive distillation process takes place in an extractive distillation column, and there are vapors at the top of the column that are condensed and returned to the column as reflux, and there are vapors that exit the top of the column and are collected as overhead product, and the weight ratio of said reflux to said overhead product is about 0.1:1 to about 5:1.

7. A process for separating at least one aromatic hydrocarbon having 6–12 carbon atoms per molecule from at least one close-boiling non-aromatic hydrocarbon comprising extractively distilling a feed mixture comprising at least one aromatic hydrocarbon and at least one non-aromatic hydrocarbon in the presence of a solvent mixture, wherein the extractive distillation process takes place in an extractive distillation column and the solvent mixture is introduced into the extractive distillation column in a weight ratio of about 3 parts solvent mixture per part of feed mixture, said feed mixture comprising n-heptane and benzene, wherein the solvent mixture comprises between about 25–75% sulfolane by weight with the remainder being N-methyl-2-pyrrolidone.

8. The process of claim 7, wherein about 20–80 weight % of said feed mixture is aromatic hydrocarbon and about 20–80 weight % of said feed mixture is non-aromatic hydrocarbon.

9. The process of claim 7, wherein said feed mixture contains at least one aromatic hydrocarbon containing 6 to 10 carbon atoms per molecule.

10. The process of claim 7, wherein said feed mixture contains at least one non-aromatic hydrocarbon containing 5 to 10 carbon atoms per molecule.

11. The process of claim 7, wherein said solvent mixture and said feed mixture are introduced to the distillation column in a weight ratio of about 0.5 to 20 parts of solvent mixture per part of feed mixture.

12. The process of claim 7, wherein the extractive distillation process takes place in an extractive distillation column, and there are vapors at the top of the column that are condensed and returned to the column as reflux, and there are vapors that exit the top of the column and are collected as overhead product, and the weight ratio of said reflux to said overhead product is about 0.1:1 to about 5:1.

* * * * *